United States Patent [19]

Jepsen

[11] 4,402,735

[45] Sep. 6, 1983

[54] TREATING DEEP SEA NODULES BY SEGREGATION ROASTING

[75] Inventor: Tage L. B. Jepsen, Gabbs, Nev.

[73] Assignee: Combustion Engineering, Inc., Windsor, Conn.

[21] Appl. No.: 380,177

[22] Filed: May 20, 1982

[51] Int. Cl.[3] ..... C22B 1/02; C22B 5/10

[52] U.S. Cl. ..... 75/1 R; 75/72; 75/80; 75/82; 423/DIG. 4

[58] Field of Search ..... 75/1 R, 72, 80, 82; 423/DIG 4

[56] References Cited

U.S. PATENT DOCUMENTS

| | | | |
|---|---|---|---|
| 3,725,039 | 4/1973 | Jepsen | 75/82 |
| 3,754,896 | 8/1973 | Iwasaki | 75/82 |
| 3,984,232 | 10/1976 | Bell | 75/80 |
| 4,002,463 | 1/1977 | Nestoridis | 75/1 R |

OTHER PUBLICATIONS

*Chemical Abstracts*, vol. 83 (1975) No. 101,167.
*Mining Engineering*, Apr. 1975, pp. 53–55.
*Derwent Abstract*, 76600X/41 (1976) of Japanese Pat. No. 96,724.

*Primary Examiner*—Brian E. Hearn
*Attorney, Agent, or Firm*—Richard H. Berneike

[57] ABSTRACT

A process for recovering nonferrous nickel, copper and cobalt from deep sea nodules to obtain a concentrate rich in the nonferrous metals, a middlings less concentrated in the nonferrous metals and a tailings with a very low concentration of the nonferrous metals. The crushed nodules are mixed with middlings, a carbonaceous reductant and a chlorinating agent which is a mixture of sodium chloride with either calcium carbonate or calcium hydroxide. In a non-oxidizing atmosphere, the mixture is roasted at a temperature about 850° C. and then cooled. The roasted material is finely ground, slurried and magnetically separated into the three fractions.

3 Claims, 1 Drawing Figure

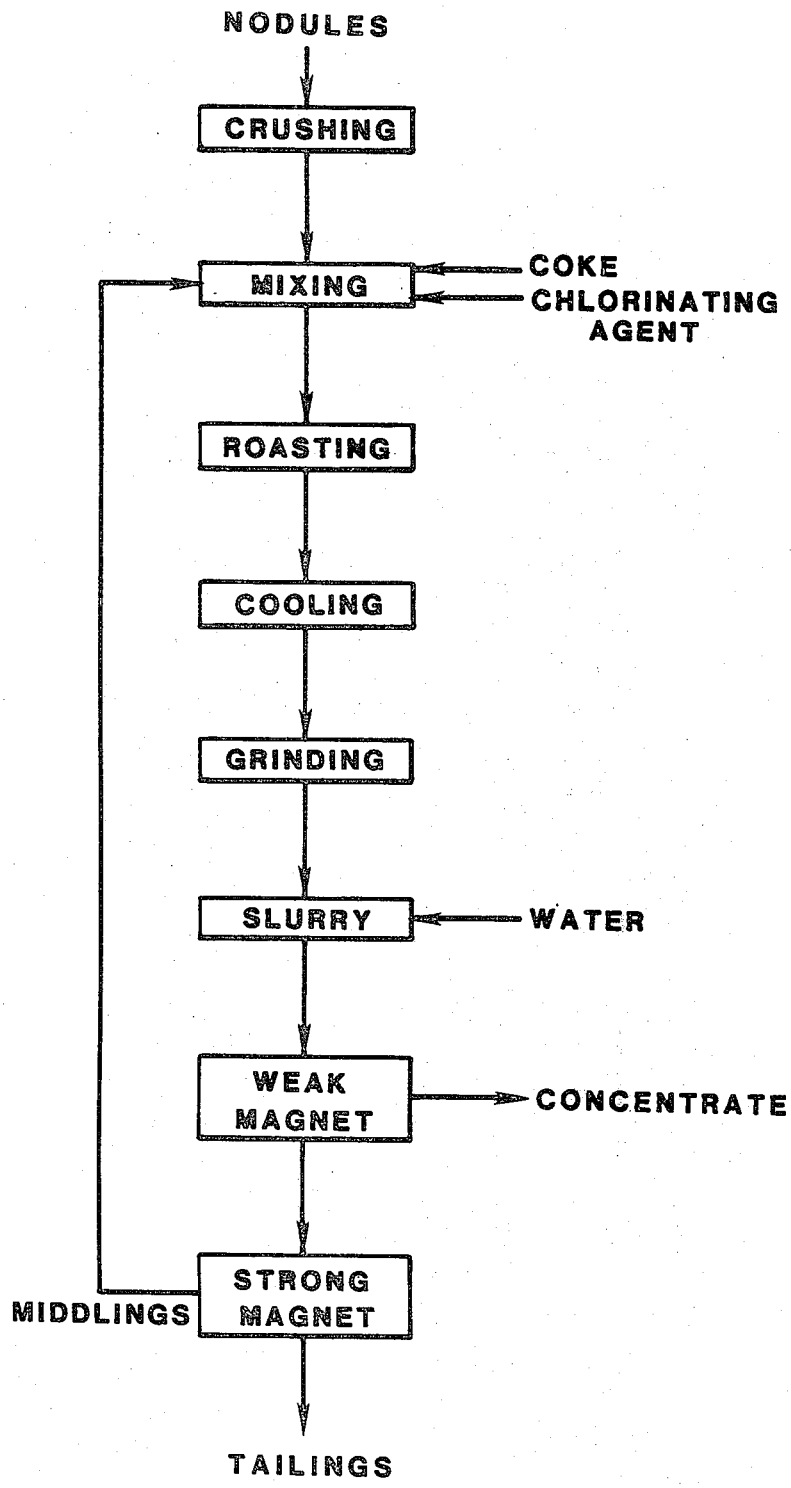
NODULES
CRUSHING
MIXING
COKE
CHLORINATING AGENT
ROASTING
COOLING
GRINDING
SLURRY
WATER
WEAK MAGNET
CONCENTRATE
STRONG MAGNET
MIDDLINGS
TAILINGS

TREATING DEEP SEA NODULES BY SEGREGATION ROASTING

The present invention relates to the recovery of non-ferrous metal values from deep sea nodules.

Deep sea nodules are composed primarily of manganese and iron with the percentage of each of these components varying rather widely depending upon the sea in which they are found and the particular area of different seas. In addition to manganese and iron, these deep sea nodules represent a large untapped source of various other metal values such as nickel, copper and cobalt. However, the concentration of these metal values is relatively low, usually less than 2% and they are finely disseminated in the nodule. Therefore, the recovery by conventional physical separation processes is not possible. Some form of upgrading is necessary in order to permit the recovery and a number of processes based on either hydro-metallurgical or pyro-metallurgical approaches have been developed for this purpose with varying degrees of success and economic justification. An object of the present invention is to provide an improved pyro-metallurgical process which will produce increased yields economically.

SUMMARY OF THE INVENTION

The present invention relates to a segregation roasting technique which involves the blending of the ground nodules with coke, a chlorinating agent and a recycled stream of a portion of the treated material which has a medium enrichment of the desired materials and which is a portion having weak magnetic properties. The resulting mixture is heated to an appropriate temperature in an autogenous atmosphere after which the mass is cooled, ground and then separated into three parts by magnetic separation. The three parts are: the portion having strong magnetic properties which contains a high concentration of the nickel, cobalt and copper and is known as the concentrate; a weakly magnetic portion which contains most of the remainder of the nickel, cobalt and copper and which is recycled for mixture with the nodules; and the remainder which is essentially stripped of the desired materials and is the discarded material. The preferred chlorinating agent is sodium chloride mixed with either calcium carbonate or calcium hydroxide.

BRIEF DESCRIPTION OF THE DRAWING

The drawing is a flow diagram illustrating the process of the present invention.

DESCRIPTION OF THE PREFERRED EMBODIMENTS

The character and chemical content of deep sea nodules varies widely depending upon the region from which the nodules are obtained. For the purposes of general background information and not intending to limit the present invention, the following is the approximate metal content range of deep sea nodules on a dry basis:

TABLE 1

| Metal Content Analysis Range | |
|---|---|
| Manganese | 10.0–40.0% |
| Iron | 4.0–25.0% |
| Nickel | 1.0–2.0% |
| Copper | 0.8–1.8% |

TABLE 1-continued

| Metal Content Analysis Range | |
|---|---|
| Cobalt | 0.1–0.5% |
| Molybdenum | 0.03–0.1% |

The remainder of the ore consists of oxygen in the form of oxides, clay minerals with lesser amounts of quartz, feldspars, other minerals and water of hydration. Of the many ingredients making up the nodules, copper, nickel and cobalt are emphasized because, from an economic standpoint, they are the most significant metals in most of the ocean floor ores.

The overall process of the present invention is illustrated in the drawing. This process begins by crushing the nodules and then mixing them with coke or other carbonaceous reductant, a chlorinating agent and a recycled middlings stream. This mixture is then roasted, cooled and ground. The resulting material is then subjected to a first separation step by means of a weak magnetic separator to produce a concentrated product stream and a stream which is sent for further separation. This further separation involves a stronger magnetic separation to produce the middling stream for recycle and the tailings which are discarded or sent for further processing for other minerals.

The first step of the process involves crushing or grinding the deep sea nodules. This generally involves crushing the nodules to pass at least a 10 mesh (Tyler Screen Size) and preferably to pass a 20 mesh screen. If the nodule particles are too large, it is not possible to homogeneously blend the reactants and intimate contact of the reactants can not be obtained. Crushing to a size finer than about −35 mesh, although possible in the present invention, has been found to be unnecessary.

The next step in the process is the segregation roasting of the nodules. Segregation roasting involves mixing the nodules with a chloridizing agent and a carbonaceous reductant and then roasting the mixture in a furnace maintained at a predetermined temperature for a predetermined period of time. In the present invention, the segregation roasting also involves adding to the mixture a recycled stream of material which will be explained hereinafter.

While the mechanism of the segregation roasting process is not completely understood, it is believed that the metals in the ore are volatilized as a chloride and then deposited in situ as a metallic alloy on the surface of the carbonaceous reductant. For the carbonaceous reductant, a variety of materials may be used such as foundry coke, petroleum coke, anthracite and charcoal. The amount of carbonaceous reductant added is from 2% to 10% and preferrably about 5% based on the weight of nodules plus middlings.

Although various chloridizing agents have been used in the past to upgrade ores, the specific chloridizing agent for the present invention is a mixture of $CaCO_3$ and NaCl or $Ca(OH)_2$ and NaCl. This particular combination of sodium chloride with either calcium carbonate or calcium hydroxide proved to be far superior to other chloridizing agents such as calcium chloride, a mixture of calcium oxide and sodium chloride and a mixture of calcium sulfate and sodium chloride. A series of tests were conducted using samples each containing 60 grams of nodules, 18 grams of middlings and 6 grams of coke. Each sample then had a different chloridizing agent added. After roasting and separating, the results with respect to the concentration of nickel and copper were as follows:

TABLE 2

| Chloridizing Agent | Product | Wt. % | Assay % Ni | Assay % Cu | Percent Distribution Ni | Percent Distribution Cu |
|---|---|---|---|---|---|---|
| Sample 1 | Conc. | 7.1 | 12.30 | 6.80 | 43.3 | 31.1 |
| 14g. $CaCO_3$ | Mid. | 32.9 | 2.38 | 1.70 | 38.8 | 36.0 |
| 16g. NaCl | Tail | 60.0 | 0.60 | 0.85 | 17.9 | 32.9 |
| | Feed | 100.0 | 2.01 | 1.55 | 100.0 | 100.0 |
| Sample 2 | Conc. | 8.6 | 12.10 | 7.00 | 46.7 | 35.9 |
| 11g. $Ca(OH)_2$ | Mid. | 34.3 | 2.64 | 1.85 | 40.7 | 37.9 |
| 16g. NaCl | Tail | 57.1 | 0.49 | 0.77 | 12.6 | 26.2 |
| | Feed | 100.0 | 2.23 | 1.68 | 100.0 | 100.0 |
| Sample 3 | Conc. | 9.8 | 12.68 | 7.50 | 59.4 | 43.6 |
| 15g. $CaCl_2$ | Mid. | 19.7 | 1.81 | 1.32 | 17.0 | 15.4 |
| | Tail | 70.5 | 0.70 | 0.98 | 23.6 | 41.0 |
| | Feed | 100.0 | 2.09 | 1.69 | 100.0 | 100.0 |
| Sample 4 | Conc. | 12.5 | 5.07 | 2.55 | 30.1 | 21.0 |
| 8g. CaO | Mid. | 33.3 | 2.52 | 1.57 | 39.8 | 34.4 |
| 16g. NaCl | Tail | 54.2 | 1.17 | 1.25 | 30.1 | 44.6 |
| | Feed | 100.0 | 2.11 | 1.52 | 100.0 | 100.0 |
| Sample 5 | Conc. | 3.0 | 2.87 | 1.66 | 4.2 | 3.4 |
| 24g. $CaSO_4$ | Mid. | 9.1 | 2.12 | 1.31 | 9.4 | 8.3 |
| 16g. NaCl | Tail | 87.9 | 2.03 | 1.45 | 66.4 | 88.3 |
| | Feed | 100.0 | 2.06 | 1.44 | 100.0 | 100.0 |

In Sample 1, the feed contained 2.01% nickel whereas the concentrate contained 12.30% nickel. It can be seen that this is rather large increase in the concentration of nickel. A significant increase in the concentration of copper in the concentrated product can also be seen. Furthermore, the distribution of the total is 43.3% in the concentrate, 38.8% in the middlings and only 17.9% in the tailings. It can also be seen from this table that only 32.9% of the total copper in Sample 1 is in the tailings. Since only the tailings are discarded, a large percentage of the nickel and copper have been concentrated in the concentrate product and the middlings. The same beneficial results can be seen for Sample 2 wherein only 12.6% of the total nickel and 26.2% of the total copper are in the tailings. However, in Sample 3 the percentage of nickel and copper is the tailings is significantly increased to 23.6 and 41.0%, respectively. The percentage of nickel and copper found in the tailings of Samples 4 and 5 is even larger. From this table, it can be seen that the chloridizing agents for Samples 3, 4 and 5 are significantly inferior to the chloridizing agents used in Samples 1 and 2. It should be noted that the amount of calcium and chlorine added in the form of the carbonate, the hydroxide and the chloride is approximately the same in each sample. The assay of the feed is calculated from the assay of the products.

The ratio of sodium chloride to either calcium carbonate or calcium hydroxide which is added is selected to give a molecular ratio of calcium to chloride of 1 to 2 which is the ratio found in calcium chlorides. For the mixture of calcium carbonate and sodium chloride, an amount equal to about 30% to 60% and preferably about 50% by weight of the fresh nodules is added. This preferred amount would be about 23 grams of calcium carbonate and 27 grams of sodium chloride per 100 grams of fresh nodules. For the mixture of calcium hydroxide and sodium chloride, the actual amount added by weight would be reduced as a result of the difference in the molecular weight of calcium carbonate and calcium hydroxide. In this instance, the preferred amount would be about 44% by weight of the fresh nodules. This would be about 17 grams of calcium hydroxide and 27 grams of sodium chloride per 100 grams of fresh nodules. Adding significantly more or less than these ranges will reduce the grade of the concentrate and the percent recovery.

After the middlings have been added (which will be explained in detail hereinafter) the materials and thoroughly mixed and then subjected to the segregation roasting process.

The segregation roasting is carried out in an inert or autogenous atmosphere. The easiest and most economical induced atmosphere to use is nitrogen although the invention is not limited to nitrogen and any inert gas may be used to prevent oxidation. One technique is to purge the furance with nitrogen and then merely allow an autogenous atmosphere to form during the roasting. Another technique is to continuously sweep the furnace with a small flow of inert gas.

The roasting process is accomplished by raising the temperature of the material itself above about 850° C. for about 60 minutes. It is important to note that this is the temperature of the material itself and not the temperature of the atmosphere or the furnace at any particular location. In other words, it is important that the furnace conditions and the location of the material in the furnace be such that there is efficient heat transfer to the material to raise and maintain it at the required temperature for the required period of time. This 60 minute time period is actually the preferred time and the time may be anywhere from 45 to 75 minutes. With times less than about 45 minutes, the reaction has been incomplete and times over about 75 minutes have shown no additional benefit. In the process, gases are generated that carry the volatilized metals unto the face of the carbon. When gases are no longer evolved, the process has then been completed.

With respect to the temperature of the roasting process, the following data illustrates that the temperature of the roasting process should be above 850° C. This data clearly shows that the effectiveness of the segregation drops off rapidly below about 850° C. The temperature may be raised above 1000° C. as long as the temperature remains below the fusing point of the materials.

TABLE 3

| Temp. | Product | Wt. % | Assay % Ni | Assay % Cu | Assay % Co | Percent Distribution Ni | Percent Distribution Cu | Percent Distribution Co |
|---|---|---|---|---|---|---|---|---|
| 1000° C. | Conc. | 3.6 | 28.16 | 15.52 | 6.00 | 48.1 | 30.8 | 42.8 |
| | Mid. | 56.4 | 1.83 | 1.82 | 0.47 | 49.3 | 56.6 | 52.5 |
| | Tail | 40.0 | 0.12 | 0.57 | 0.06 | 2.3 | 12.6 | 4.7 |
| | Feed | 100.0 | 2.09 | 1.81 | 0.51 | 100.0 | 100.0 | 100.0 |
| 950° C. | Conc. | 3.6 | 27.80 | 14.96 | 5.08 | 46.2 | 34.2 | 40.1 |
| | Mid. | 56.4 | 1.88 | 1.37 | 0.42 | 48.9 | 49.0 | 52.0 |
| | Tail | 40.0 | 0.27 | 0.66 | 0.09 | 4.9 | 16.8 | 7.9 |
| | Feed | 100.0 | 2.17 | 1.58 | 0.46 | 100.0 | 100.0 | 100.0 |
| 900° C. | Conc. | 3.6 | 21.32 | 10.08 | 3.60 | 37.3 | 23.9 | 29.0 |
| | Mid. | 56.4 | 1.98 | 1.47 | 0.45 | 54.3 | 54.5 | 56.7 |
| | Tail | 40.0 | 0.43 | 0.82 | 0.16 | 8.4 | 21.6 | 14.3 |
| | Feed | 100.0 | 2.06 | 1.52 | 0.45 | 100.0 | 100.0 | 100.0 |
| 850° C. | Conc. | 4.3 | 17.48 | 8.84 | 3.60 | 33.4 | 22.7 | 28.8 |
| | Mid. | 70.1 | 1.98 | 1.57 | 0.50 | 61.6 | 65.7 | 65.1 |
| | Tail | 25.6 | 0.44 | 0.76 | 0.13 | 5.0 | 11.6 | 6.1 |
| | Feed | 100.0 | 2.25 | 1.68 | 0.54 | 100.0 | 100.0 | 100.0 |
| 800° C. | Conc. | 12.1 | 4.36 | 2.40 | 0.92 | 26.9 | 20.2 | 12.4 |
| | Mid. | 56.9 | 2.12 | 1.51 | 0.53 | 61.5 | 59.8 | 72.1 |
| | Tail | 31.0 | 0.73 | 0.93 | 0.21 | 11.6 | 20.0 | 15.5 |
| | Feed | 100.0 | 1.96 | 1.44 | 0.42 | 100.0 | 100.0 | 100.0 |

In the preferred form of the present invention, the material in the roasting furnace is first preconditioned or soaked for about 60 minutes at about 250° C. It is not understood why, but this procedure improves the segregation during the roasting process. The present invention may be carried out in any type of furnace or heating device in which the atmosphere can be properly controlled and which will provide sufficient heat transfer to the material to raise and maintain the material at the proper temperature for the required length of time. Furnaces which can be used are tube or muffle furnaces both having an externally heated chamber with the walls of the chamber radiently heating the contents of the chamber.

After the roasting process, the roasted material is cooled in the inert atmosphere so as to prevent oxidation. After cooling, the material is ground to −270 mesh and preferably 100%-500 mesh or about 25 microns. Grinding may be carried out in equipment such as a rod or ball mill and is preferably wet ground. This fine grinding is for the purpose of liberating the magnetic nickel-copper-cobalt particles from the non-magnetic gangue.

The product from the segregation roasting and grinding operation produces three types of particles. The first type has relatively strong magnetic properties and has a relatively high assay for nickel, copper, cobalt and iron. The second group of particles has significantly lower magnetic properties and has a significantly lower assay for these elements. The third group of particles has essentially no magnetic properties and has a very low assay for these elements. The quantity of particles having the high magnetic properties, the concentrate, is relatively low and usually less than 10 or 15% of the total amount of particles. The quantity of particles having the lower magnetic properties, the middlings, is anywhere from about 40–60% of the total and the non-magnetic tailings form the remainder.

The next step in the process is to separate the particles into these three groups. This separation is accomplished by magnetic techniques. The first step is to blend the crushed particles into a very dilute water slurry, preferably about 5% solids. This helps prevent non-magnetic particles from being entrapped and carried along with the magnetic particles. The solids concentration of the slurry is not critical but the more dilute it is, the better the separation. This slurry is then passed over a low intensity magnetic separator using a flux density of about 1100 gauss. This low intensity magnetic separator will separate from the slurry those particles having highly magnetic properties, i.e., the concentrate.

After the particles having the high magnetic properties have been separated in the low intensity magnetic separator, the remaining slurry is fed to a high intensity magnetic separator having a flux density of about 15,000 gauss in which the particles having the lower magnetic properties are separated. These particles are referred to herein as the middlings. It is these middlings that are recycled and mixed with the raw nodules, coke and chlorinating agent. The magnetic flux densities of the two separators are given only as examples and they may be varied as desired to provide the desired separation in any particular case.

The effect of the amount of middlings recycled can be seen from the examples in Table 4. Each sample contained 100 grams of nodules, 23 grams of calcium carbonate, 27 grams of sodium chloride, 5 grams of petroleum coke and the amount of middlings as indicated for each sample.

TABLE 4

| Middlings | Product | Wt. % | Assay % Ni | Assay % Cu | Assay % Co | Percent Distribution Ni | Percent Distribution Cu | Percent Distribution Co |
|---|---|---|---|---|---|---|---|---|
| No Middlings | Conc. | 2.5 | 15.68 | 8.80 | 1.68 | 26.4 | 20.0 | 14.3 |
| | Mid. | 48.1 | 2.03 | 1.30 | 0.40 | 65.6 | 56.7 | 65.5 |
| | Tail | 49.1 | 0.24 | 0.52 | 0.12 | 8.0 | 23.3 | 20.2 |
| | Feed | 100.0 | 1.48 | 1.10 | 0.29 | 100.0 | 100.0 | 100.0 |
| 25 g. Middlings | Conc. | 1.8 | 27.68 | 14.92 | 4.32 | 31.7 | 22.7 | 18.3 |
| | Mid. | 52.1 | 1.87 | 1.31 | 0.50 | 62.1 | 57.6 | 61.1 |
| | Tail | 46.1 | 0.21 | 0.55 | 0.19 | 6.2 | 19.7 | 20.6 |
| | Feed | 100.0 | 1.57 | 1.19 | 0.43 | 100.0 | 100.0 | 100.0 |
| 50 g. Middlings | Conc. | 2.4 | 35.00 | 23.40 | 3.11 | 49.3 | 39.2 | 26.7 |
| | Mid. | 52.9 | 1.49 | 1.31 | 0.27 | 46.2 | 48.3 | 50.9 |
| | Tail | 44.7 | 0.17 | 0.40 | 0.14 | 4.5 | 12.5 | 22.4 |
| | Feed | 100.0 | 1.70 | 1.43 | 0.28 | 100.0 | 100.0 | 100.0 |
| 75 g. | Conc. | 2.4 | 22.68 | 13.60 | 2.50 | 33.5 | 22.9 | 25.8 |
| | Mid. | 54.2 | 1.78 | 1.51 | 0.24 | 59.5 | 57.5 | 55.8 |
| | Tail | 43.4 | 0.26 | 0.64 | 0.10 | 7.0 | 19.6 | 18.4 |
| | Feed | 100.0 | 1.62 | 1.42 | 0.23 | 100.0 | 100.0 | 100.0 |
| 100 g. Middlings | Conc. | 1.2 | 22.68 | 14.00 | 2.85 | 18.3 | 12.3 | 13.4 |
| | Mid. | 58.1 | 1.91 | 1.63 | 0.30 | 74.6 | 69.5 | 68.8 |
| | Tail | 40.7 | 0.22 | 0.61 | 0.11 | 7.1 | 18.2 | 17.8 |
| | Feed | 100.0 | 1.49 | 1.36 | 0.25 | 100.0 | 100.0 | 100.0 |

As can be seen from this Table 4, the assay and percent distribution for the concentrate is the highest with 50 grams of middlings. As the amount of middlings are either increased or decreased, the assay and percent recovery decrease. When no middlings are added, both the concentrate assay and the percent recovery are low whereas with 100 grams of middlings, the assay is relatively high but the percent recovery is lower.

During the roasting process and ignition loss occurs which is caused partly by moisture loss from the nodules and partly by the loss of volatile matter. Also, when the roasted material is slurried with water, there is an additional soluble loss. The combined ignition loss and soluble loss is typically about 40% of the furnace feed. However, it should be noted that only traces of the metal values are part of these losses. After the losses are deducted from the weight of the furnace feed, it turns out that the weight of middlings obtained is within the range of the amount of middlings to be recycled.

I claim:

1. A process for recovering a concentrate upgraded in the content of at least one nonferrous metal value selected from the group consisting of nickel, copper and cobalt from deep sea nodules comprising the steps of:

a. producing a feed material comprising mixing:
   i. 100 parts by weight of said nodules;
   ii. 40 to 60 parts by weight of middlings as defined in step (f) (ii);
   iii. 30 to 60 parts by weight of a chloridizing agent comprising a mixture of sodium chloride and a calcium compound selected from the group consisting of calcium carbonate and calcium hydroxide in the ratio of about 1 mole of calcium compound to 2 moles of sodium chloride; and
   iv. 2 to 10 parts by weight of a carbonaceous reductant;

b. roasting said feed material in a non-oxidizing atmosphere wherein said feed material is heated to a temperature above 850° C.;

c. cooling said roasted material in a non-oxidizing atmosphere;

d. grinding said cooled roasted material to at least minus 270 mesh;

e. forming a slurry of said ground material; and f. separating from said slurry by magnetic separation:

i. a material having relatively high magnetic properties and concentrated in said non-ferrous metal values;

ii. a middlings material having lower magnetic properties and less concentrated in said non-ferrous metal values; and iii. a non-magnetic tailings material low in said nonferrous metal values.

2. A process as recited in claim 1 wherein said material in roasting step (b) is held at said temperature for 45 to 75 minutes.

3. A process as recited in claim 1 or 2 wherein said material in step (d) is ground to about 100% minus 500 mesh.

* * * * *